United States Patent [19]

Eadie et al.

[11] 4,132,058

[45] Jan. 2, 1979

[54] INSERT TRAVELLER

[75] Inventors: Brian K. M. Eadie, Brookfield; James W. Craighead, Glasgow; Alistair A. McKerrell; Robert Wilson, both of Paisley; William A. White, Glasgow, all of Scotland

[73] Assignee: Textile Mouldings Limited, Accrington, England

[21] Appl. No.: 832,780

[22] Filed: Sep. 13, 1977

[30] Foreign Application Priority Data

Sep. 23, 1976 [GB] United Kingdom ..... 39453/76

[51] Int. Cl.[2] ..... D01H 7/60

[52] U.S. Cl. ..... 57/125

[58] Field of Search ..... 57/119, 125

[56] References Cited

U.S. PATENT DOCUMENTS

| | | | |
|---|---|---|---|
| 2,121,647 | 6/1938 | Wentworth | 57/125 |
| 2,999,276 | 9/1961 | Morin | 57/125 X |
| 3,320,736 | 5/1967 | Morin | 57/125 |
| 3,362,152 | 1/1968 | Mackie | 57/125 |
| 3,364,671 | 1/1968 | Morin | 57/125 |

FOREIGN PATENT DOCUMENTS

| | | | |
|---|---|---|---|
| 2049137 | 4/1972 | Fed. Rep. of Germany | 57/125 |
| 2112547 | 10/1972 | Fed. Rep. of Germany | 57/125 |

*Primary Examiner*—Charles Gorenstein
*Attorney, Agent, or Firm*—Donald H. Feldman

[57] ABSTRACT

An insert traveller, of the kind comprising an upper and lower hook portions interconnected by a shank, all of plastics material, with a metal insert for contacting the yarn arranged at the junction of the upper hook portion and the shank, is improved by providing portions on the upper hook portion and the shank whereby the insert can be embedded within the portion of the shank adjacent or beyond the internal surface of main body of the portion of the shank. The metal insert is of "half-round" wire and carries a fin interconnecting the upper hook portion and the shank of "T" shape cross-section.

6 Claims, 2 Drawing Figures

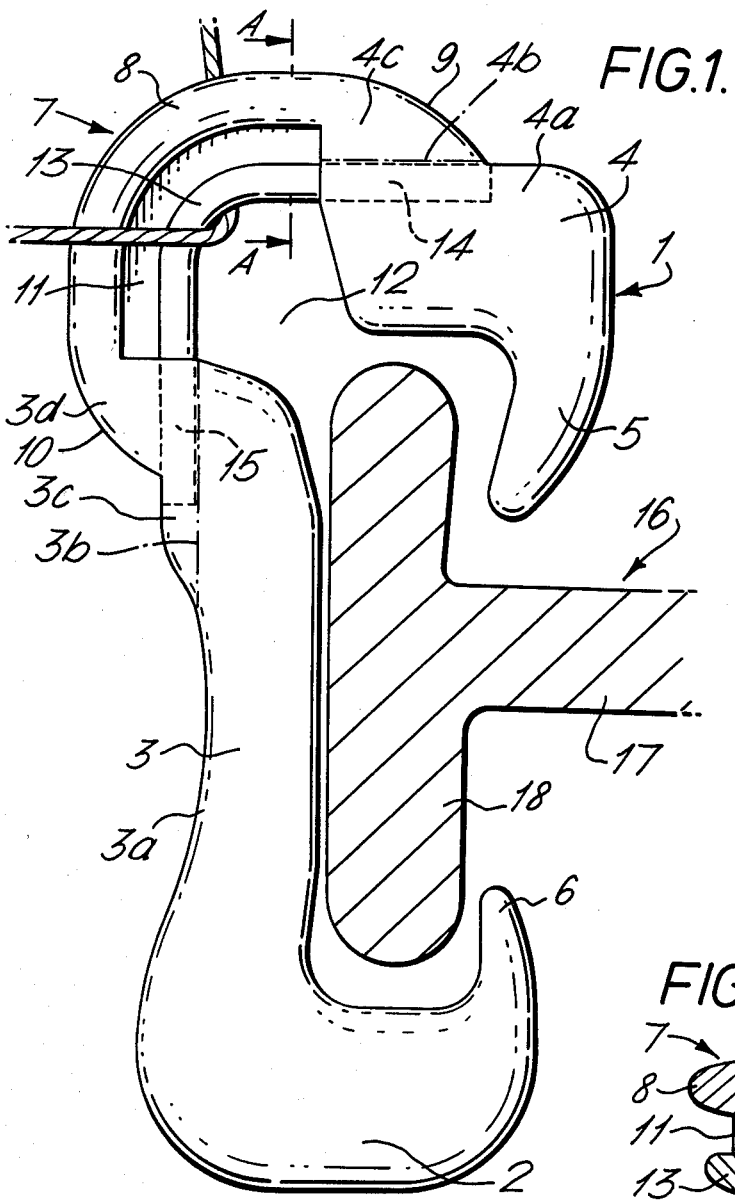
FIG.1.
FIG.2.
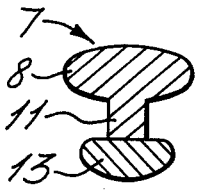

INSERT TRAVELLER

FIELD OF THE INVENTION

This invention relates to travellers for ring spinning and twisting frames and particularly to travellers of the type known as insert travellers, which are formed of a plastics material at those parts which bear upon the ring with an insert of a hard wear resistant material for example metal or ceramic at the part which engages the yarn. Particularly the travellers include upper and lower hook portions interconnected by a shank with the metal insert embedded at the junction of the upper hook portion and the shank.

DESCRIPTION OF THE PRIOR ART

British Design Registration No. 925,182 shows a traveller of this type wherein the metal insert is embedded within the upper hook portion and the shank at approximately the mid point thereof, measuring from the inner surface outwardly. This traveller has achieved much success and has been sold widely but has not been suitable for many applications because it does not last sufficiently long under wear from friction with the spinning ring. Additionally some difficulty can be encountered with remaining fibres which become wrapped around the fin since they cannot readily be slipped over the nose of the upper hook portion.

More recently a traveller as shown in German O.L.S. No. 2603990 has become available which has the insert extending substantially wholly through the plastics parts and exposed along a portion of its length so as to effect air cooling of the insert.

SUMMARY OF THE INVENTION

It is one object of the invention to provide traveller with improved life.

It is a further object of the invention to provide a traveller with a fin which assists in preventing the wrapping of stray fibres around the insert and additionally enables ready removal of any fibres which do become so trapped.

The invention provides an insert traveller for a ring spinning or twisitng frame comprising an upper hook portion and a lower hook portion interconnected by a shank, the portions and the shank being formed of plastics material, and an insert of a hard wear resistant material for contacting the yarn arranged at the junction of and extending only part way into the upper hook portion and the shank, wherein each of the upper hook portion and the shank includes a portion extending outwardly from the main body of the upper hook portion and shank respectively whereby the part of the insert embedded in the hook portion and the shank respectively is arranged adjacent or beyond the outermost surface of the respective main body.

This arrangement wherein the insert is positioned adjacent or beyond the outermost surface of the main body of the upper hook position and/or the shank in comparison with conventional travellers of this type wherein the insert is positioned substantially centrally, provides a greatly increased life for the traveller. This is due to the fact that substantially more plastics material is present between the ring and the insert thus enabling more wear before contact or imminent contact between the insert and the ring renders the traveller useless.

Furthermore, the new positioning of the insert provides a greatly increased yarn clearance between the insert and the ring which is of major advantage.

The invention may also, particularly in smaller sized travellers, provide a better distribution of weight enabling the traveller to run with no accentuated wear at the knee.

According to a preferred feature of the invention the traveller includes a fin joining the upper hook portion and the shank, the fin being of 'T'-shape in cross-section. Fins are necessary to prevent fibres from becoming wrapped around the insert, but the new 'T'-shaped cross-section has been found to be advantageous in that it may enable fibres which do become wrapped around the insert, with a little bit of manoeuvering, to be removed over the upper hook portion of the traveller.

According to a further preferable feature, the insert is formed of wire of substantially part-elliptical cross-section with the major axis of the ellipse extending transversely of the traveller so as to provide a wide surface which is contacted by the yarn while avoiding unnecessary weight of the metal insert.

BRIEF DESCRIPTION OF THE DRAWINGS

FIG. 1 is a side elevation of a traveller; and

FIG. 2 is a cross-sectional elevation on the lines A—A of FIG. 1.

DESCRIPTION OF THE PREFERRED EMBODIMENT

The traveller 1 is generally of ear-shaped configuration and comprises an upper hook portion 4, a lower hook portion 2 and a shank 3. The upper hook portion 4 terminates in a depending nose 5 and the lower hook portion 2 terminates in an upturned toe 6.

The upper hook portion 4 comprises a main body **4*a* including the nose 5 and terminating at its extremity at chain-dot line 4*b*. The shank 3 comprises a main body 3*a* contiguous with the lower hook portion 2 at its lower extremity and defined by a chain-dot line 3*b* at the upper extremity. It will be apparent that the shape of each of the main bodies 4*a* and 3*a*** follows substantially the shape of conventional travellers of this type.

The upper hook portion 4 further includes an outwardly extending portion **4*c* contiguous with the main body 4*a*. The shank 3 includes a first outwardly extending portion 3*c* contiguous with the main body 3*a* and forming a short extension thereof over the order of one third the length of the shank 3. A second portion 3*d* similar in shape to the portion 4*c* is contiguous with the portion 3*c*. The portions 4*c*, 3*c* and 3*d* are of the same width as the main bodies 3*a* and 4*a***.

Interconnecting the main body **4*a* of the upper hook portion 4 with the portion 3*c* of the shank 3 is a fin 7 comprising a substantially elliptical cross-sectional web 8 which has a width equal to the width of the main body 4 of the upper hook portion 4 and of the shank 3. The web 8 projects outwardly from the upper hook portion 4 and the shank 3 and its outer surface is connected to the outer surface of the upper hook portion 4 by an arcuate surface 9 of the portion 4*c* and to the outer surface of the portion 3*c* of the shank 3 by an arcuate surface 10 of the portion 3*d*. Projecting inwardly from the internal surface of the web 8 is a rib 11 which forms with the web 8** a 'T'-shaped cross-section.

All the aforementioned portions of the traveller are integrally formed from a plastics material which is preferably glass-filled nylon.

The internal surface of the upper hook portion 4 and the shank 3 are relieved to form a deep yarn channel 12 which terminates at a yarn contacting insert 13. The insert 13 is formed in an L-shaped configuration from hardened high-carbon wire of cross-section known as "half-round" which is elliptical in cross-section with a small upper segment of the ellipse removed, the major axis of the ellipse extending in the direction of the width of the traveller. Thus the "half-round" wire advantageously provides a long yarn contacting path and a large yarn contact area.

Other shapes for the cross-section of the insert could be used and it is of particular advantage to use a non-circular wire in order to avoid rotation of the plastics part relative to the wire.

An upper arm 14 of the insert 13 extends only part way into the hook portion 4 in an upper portion thereof such that the upper surface of the arm 14 is coincident or approximately coincident with the upper outer surface of the main body of the portion 4. The portion 4 has a bearing surface on its underside surface parallel to the arm 14, with the amount of material between the surface and the arm being thicker than the nose 5 and substantially the same thickness as the shank 3 so as to provide a substantial amount of material for wear before the insert is in a position to contact the ring. The lower arm 15 of the insert 13 extends only part way into the portion 3*c* of the shank 3 such that the outer surface thereof is coincident or substantially coincident with the outer surface of the portion 3*c*. The insert 13 is so positioned during moulding of the traveller that in the finished product the upper surface of the arm 14 is visible between its end and the junction of the surface 9 with the upper outer surface of the body 4 or is covered at that location only with a very thin layer of the plastics material. Likewise, the outer surface of the end portion of the lower arm 15 is visible or only slightly covered from its end to the junction of the surface 10 with the outer surface of the shank 3. The breaking out of the portions of the upper and lower arms through the surface of the plastics portion facilitates location of the insert during the moulding process.

It will be appreciated that it is necessary, in order to prevent the insert 13 from being pulled out of the shank 3 and the hook portion 4 during use to provide sufficient plastics material in which the ends are embedded. The portions 4*c* and 3*d* are of sufficient mass to provide such adequate location. The portion 3*c* serves to mount the end 15 of the insert 13 beyond the outermost surface of the main body 3*a* of the shank 3.

In an alternative arrangement, the portion 3*c* could be omitted whereby the insert 13 lies adjacent the outermost surface of the main body 3*a* retained in position by the portion 3*d*. In a further alternative arrangement a portion similar to the portion 3*c* could be provided on the main body 4*a* of the hook portion 4.

In operation, the traveller is supported on a spinning ring 16 having a horizontal supporting portion 17 and a vertical flange ring 18. A yarn 19 extending from yarn delivery means (not shown) to a yarn package (not shown) passes through the yarn channel 12 whilst in contact with the insert 13. Rotation of the yarn package causes the yarn to revolve the traveller around the ring 18 whereby twist is inserted in the yarn as it accumulates on the package.

It will be seen that the substantial depth of the yarn channel 12 provides for more plastics material between the ring 18 and the insert 13 advantageously enabling more wear to take place before contact between the insert and the ring than with hitherto known insert travellers of this kind. Furthermore, the substantial depth of the yarn channel 12 provides an increased yarn clearance between the insert and the traveller thereby minimising the risk of trapping the yarn during operation.

We claim:

1. An insert traveller for a ring spinning or twisting frame comprising an upper hook portion and a lower hook portion interconnected by a shank, the portions and the shank being formed of plastics material, and an insert of a hard wear resistant material for contacting the yarn arranged at the junction of and extending only part way into the upper hook portion and the shank, wherein each of the upper hook portion and the shank includes a portion extending outwardly from the main body of the upper hook portion and shank respectively and the part of the insert embedded in the hook portion and the shank respectively is substantially coextensive with said outwardly extending portion and is arranged adjacent or beyond the outermost surface of the respective main body.

2. An insert traveller for a ring spinning or twisting frame comprising an upper hook and a lower hook interconnected to a shank, said hooks and shank being formed of a plastic material and each having a body portion with an inwardly facing bearing surface, and an insert of a hard, wear-resistant material interconnecting said upper hook and shank and being embedded in each so as to extend thereinto only part way, said body portion of each of said upper hook and shank having an outwardlly extending portion into which said insert is embedded whereby the inner surface of said insert is positioned adjacent to the outermost surface of said body portion to provide a maximum distance between said insert surface and the respective bearing surface of said upper hook and shank, wherein said upper hook includes a first portion having said bearing surface substantially parallel to said insert embedded in said adjacent outwardly extending portion and a depending nose portion, and wherein the distance between said bearing surface and said insert is greater than the thickness of said nose portion.

3. A traveller according to claim 1, including a fin of plastics material extending outwardly of the insert and interconnecting the upper hook portion and the shank.

4. A traveller according to claim 3, wherein the fin is of 'T'-shape cross-section.

5. A traveller according to claim 4, wherein the width of the fin is the same as width of the upper hook portion and the shank.

6. A traveller according to claim 1, wherein the insert is formed of wire of a substantially part-elliptical cross-section with the major axis of the ellipse extending transversely of the traveller.

* * * * *